United States Patent [19]

Wahle et al.

[11] 4,041,958

[45] Aug. 16, 1977

[54] APPARATUS FOR PRODUCING A CONTINUOUS TOBACCO STREAM

[75] Inventors: Günter Wahle, Reinbek; Dieter Ludszeweit, Hamburg; Jürgen Gömann, Dassendorf; Horst Zessin, Hamburg, all of Germany

[73] Assignee: Hauni-Werke Korber & Co. KG, Hamburg, Germany

[21] Appl. No.: 547,447

[22] Filed: Feb. 6, 1975

[30] Foreign Application Priority Data

Mar. 2, 1974 Germany ..... 2410168

[51] Int. Cl.[2] ..... A24B 3/00; A24C 5/00

[52] U.S. Cl. ..... 131/84 B

[58] Field of Search ..... 131/84 B, 84 C, 84 R, 131/108, 109, 110, 21 B, 21 A

[56] References Cited

U.S. PATENT DOCUMENTS

| | | | |
|---|---|---|---|
| 1,772,715 | 8/1930 | Grupe | 131/84 R UX |
| 1,869,395 | 8/1932 | Stelzer | 131/110 |
| 2,635,301 | 4/1953 | Schubert et al. | 131/84 B UX |
| 3,030,966 | 4/1962 | Lanore | 131/110 X |
| 3,092,117 | 6/1963 | Labbe | 131/84 B X |
| 3,318,314 | 5/1967 | Stelzer | 131/84 C |
| 3,590,826 | 7/1971 | Wochnowski et al. | 131/108 X |

FOREIGN PATENT DOCUMENTS

| | | | |
|---|---|---|---|
| 1,106,498 | 3/1968 | United Kingdom | 131/84 B |
| 919,150 | 2/1963 | United Kingdom | 131/84 C |

*Primary Examiner*—Robert W. Michell
*Assistant Examiner*—Vincent Millin
*Attorney, Agent, or Firm*—Peter K. Kontler; John Kurucz

[57] ABSTRACT

Apparatus for producing a narrow tobacco stream ready for trimming or immediate wrapping into a web of cigarette paper has a distributor from which a web first belt or a plate transports a thin carpet of tobacco particles to a first transfer station where the carpet is transferred by suction and preferably also by compressed air onto a narrower foraminous second belt forming part of an intermediate conveyor with an independent drive. The second belt is inclined with respect to and narrower than the first belt or plate and accumulates a layer of tobacco particles which are attracted to the second belt by a suction chamber extending from the first transfer station to a second transfer station where the layer is transferred onto a foraminous third belt to form thereon a narrow stream. A second suction chamber attracts the stream to the third belt during transport from the second transfer station to a third transfer station where the stream is transferred onto a web of cigarette paper moving with one stretch of the garniture and is thereupon caused to pass through a wrapping mechanism. The transfer of tobacco from the second onto the third belt is assisted by compressed air. Repeated transfer of tobacco by suction and compressed air contributes to homogenization of tobacco during conversion of the carpet into the stream.

10 Claims, 5 Drawing Figures

2
5
6
3
4
34
7
A
11
32
22
23A
24
37
23
33
24
36
23B
29
38
31
16
45
28
44A
12
B
44
39
43
41
42

APPARATUS FOR PRODUCING A CONTINUOUS TOBACCO STREAM

BACKGROUND OF THE INVENTION

The present invention relates to improvements in apparatus for making a continuous tobacco stream, and more particularly to improvements in apparatus for converting a relatively wide but thin mass of comminuted tobacco into a narrow tobacco stream. Still more particularly, the invention relates to improvements in tobacco stream making apparatus of the type disclosed in commonly owned British Pat. No. 1,106,498.

British Pat. No. 1,106,498 discloses an apparatus wherein a foraminous intermediate conveyor feeds tobacco into a channel defined by three endless belt conveyors. The channel has a rectangular cross-sectional outline and two of the three belt conveyors have stretches which converge in the direction of tobacco transport on the intermediate conveyor so that the width of the tobacco stream which accumulates in the channel decreases with attendant increase in density. The resulting relatively narrow but relatively dense stream is draped into a web of cigarette paper to form a continuous rod which is thereupon severed at regular intervals to yield plain cigarettes, cigarillos or the like. The web of wrapping material is advanced by one of the belt conveyors.

The just described stream forming apparatus is not entirely satisfactory because particles of tobacco are likely to be caught between neighboring conveyors and to be withdrawn from the condensed tobacco stream in the region where the belt conveyors are trained over pulleys or sheaves. Furthermore, the homogeneousness of the tobacco stream is not sufficient to warrant immediate draping into cigarette paper or the like without further equalization of density. Moreover, the apparatus reduces the size of a relatively high percentage of tobacco shreds.

SUMMARY OF THE INVENTION

An object of the invention is to provide a novel and improved apparatus which can be utilized for the making of a continuous narrow tobacco stream and wherein the conversion of a relatively wide carpet or sliver of tobacco particles into a narrow stream is effected in a small area, by resorting to simple and compact components, and without undue comminution of tobacco particles.

Another object of the invention is to provide an apparatus of the just outlined character wherein the homogeneousness of the stream is more satisfactory than in heretofore known apparatus.

A further object of the invention is to provide novel and improved means for transporting tobacco shreds from the distributor of a cigarette rod making machine to the locus where the particles of tobacco reach the garniture.

An additional object of the invention is to provide the apparatus with novel and improved means for converting a relatively wide and thin carpet of tobacco particles into a narrow homogeneous tobacco stream.

Still another object of the invention is to provide the apparatus with novel and improved means for changing the width of the mass of tobacco which leaves the distributor of a cigarette rod making or like machine on its way to the garniture.

The invention is embodied in apparatus for converting a wide carpet or sliver of tobacco particles (e.g., pure tobacco shreds or a mixture of shreds and ribs or stem) into a narrow continuous tobacco stream whose width need not appreciably exceed the diameter of a cigarette, cigar or cigarillo. The apparatus comprises a first conveyor having means (e.g., a relatively wide endless belt forming part of a distributor for shredded tobacco in a cigarette rod making machine) for transporting the carpet in a first direction on to a first transfer station, a second conveyor having a first foraminous belt for transporting the stream from a second transfer station and a first suction chamber which attracts the stream to the first belt during transport from the second transfer station on to a third transfer station where the stream is deposited onto or otherwise caused to advance with a continuous web of wrapping material, and an intermediate conveyor having a second foraminous belt extending between the first and second transfer stations, means (preferably a discrete drive which moves the second belt independently of the moving parts of the first and second conveyors) for moving the second belt in a second direction from the first toward the second transfer station and a second suction chamber for attracting tobacco to the second belt.

The width of the second belt exceeds the width of the stream (but may be less than the width of the carpet) so that the carpet which is transferred onto the second belt at the first station by air flowing into the second suction chamber (and, if necessary, with assistance from one or more nozzles which discharge compressed air) forms on the second belt a relatively wide layer of tobacco particles. The directions of movement of the carpet and the layer from an oblique angle so that the carpet is transferred onto the second belt along a zone having a length preferably greatly exceeding the width of the second belt and the second belt transports the layer to the second station at which the layer is converted into the stream by air flowing into the first suction chamber. The transfer of tobacco particles which form the layer onto the first belt can be assisted by one or more nozzles which discharge compressed air into a channel adjacent to the outer side of that stretch of the first belt which receives tobacco at the second transfer station.

The second belt can be mounted in such a way that one of its stretches receives the particles of the carpet from the first conveyor and its other stretch delivers the layer to the second transfer station. Alternatively, the upper stretch of the second belt can receive the particles of the carpet from the first conveyor and this same stretch transports the layer into the range of the first suction chamber at the second transfer station.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
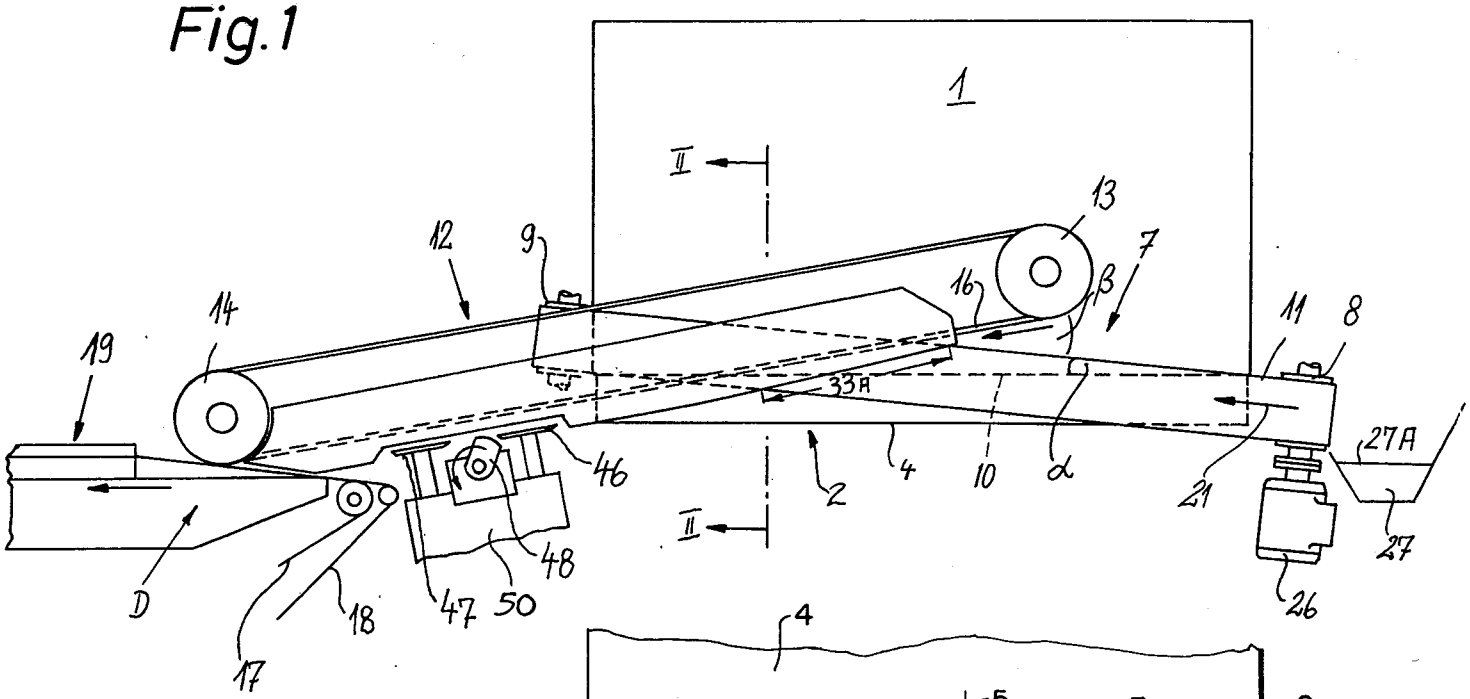
FIG. 1 is a schematic elevational view of an apparatus which embodies one form of the invention.
Figure 1A:
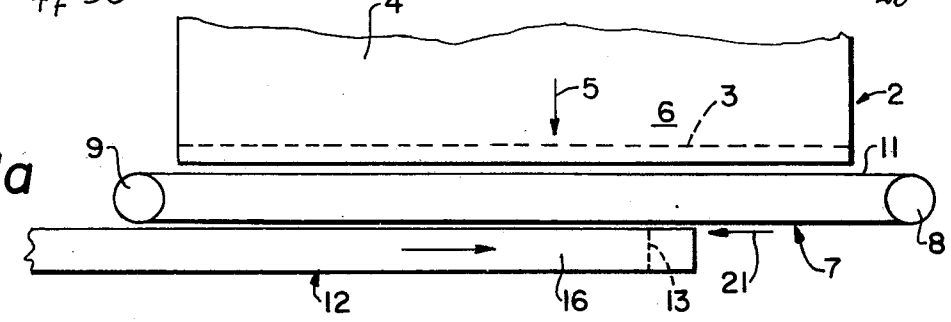
FIG. 1*a* is a fragmentary plan view of the apparatus of FIG. 1.
Figure 2:
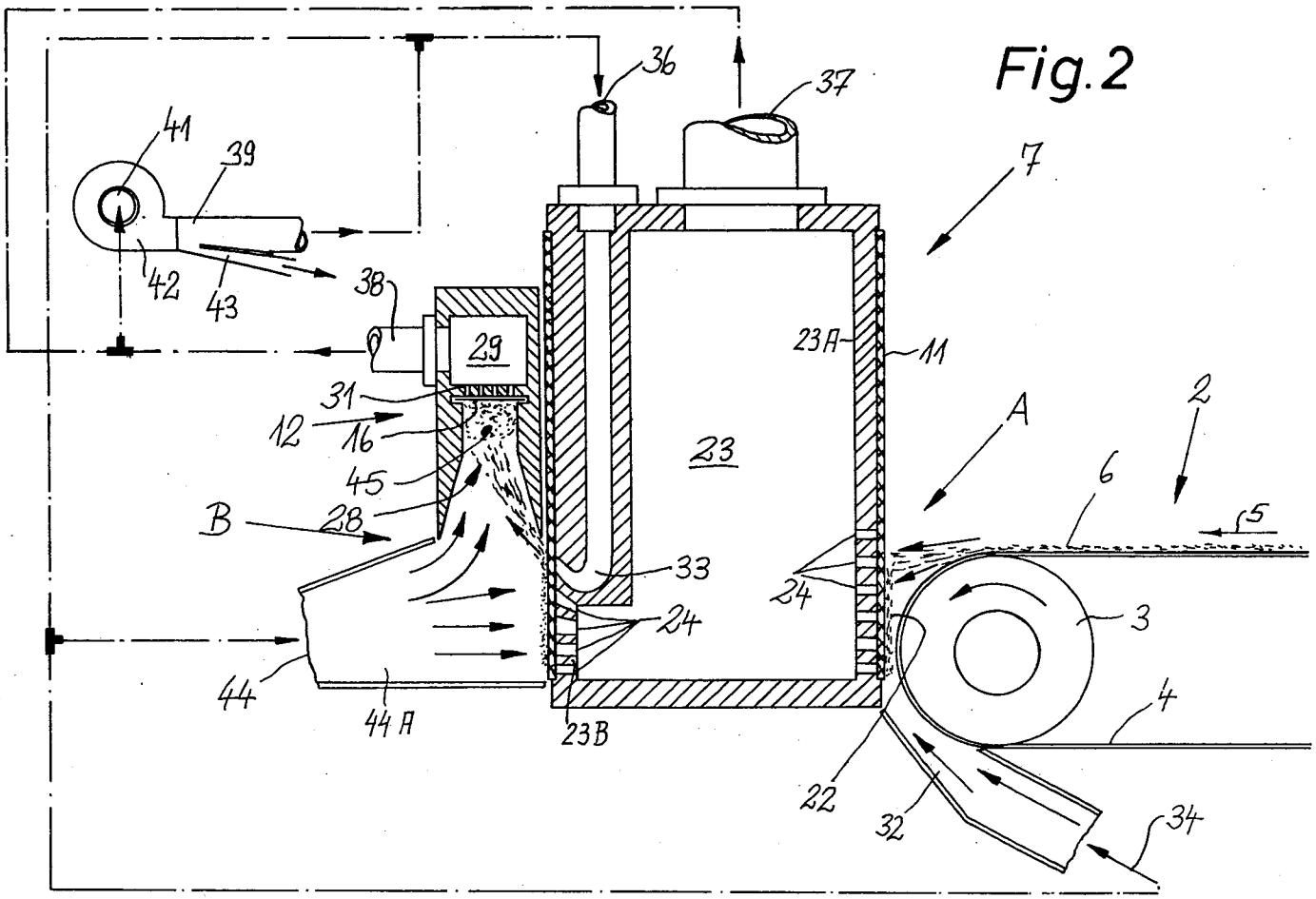
FIG. 2 is an enlarged fragmentary transverse vertical sectional view as seen in the direction of arrows from the line II—II of FIG. 1.

Referring first to FIGS. 1 and 2, there is shown an apparatus which forms part of a cigarette rod making machine and comprises a distributor 1 having a conveyor 2 including an endless belt 4 trained over several rollers 3 (one shown in FIG. 1A and 2) and receiving comminuted tobacco from a suitable magazine, not shown, so as to accumulate a relatively wide sliver or carpet 6 of comminuted tobacco consisting primarily of tobacco shreds (i.e., comminuted tobacco leaf laminae) but normally or at times containing at least some heavier tobacco particles, such as comminuted ribs and stem. The height of the sliver 6 on the upper stretch of the endless belt 4 is only a small fraction of its width. The direction in which the sliver 6 advances is indicated by arrow 5.

The apparatus further comprises an intermediate conveyor 7 including an endless foraminous belt 11 which is trained over rollers 8 and 9, and a conveyor 12 including an endless foraminous belt 16 trained over rollers 13 and 14. The effective width of the belt 16 is a small fraction of the width of the belt 4 and/or 11, and the width of the belt 11 can be a small fraction of the width of the belt 4. The relatively narrow tobacco stream 45 which is accumulated on the conveyor belt 16 is transferred onto a further endless conveyor belt 17 (known as garniture) at a transfer station D, and the garniture 17 transports the stream 45 through a wrapping mechanism 19 wherein the stream 45 is converted into a rod-like filler and is draped into a web 18 of cigarette paper to form a continuous cigarette rod. One marginal portion of the web 18 is coated with a suitable adhesive which adheres to the other marginal portion when the web is converted into a tube surrounding the rod-like tobacco filler whereby the overlapping marginal portions form a continuous seam which extends lengthwise of the rod. The latter is thereupon severed at regular intervals by a suitable cut-off mechanism (not shown) to yield a succession of discrete plain cigarettes.

The two elongated stretches of each of the conveyor belts 4, 16 and 17 respectively overlie each other (i.e., one stretch is located above the other stretch of the respective belt) and at least one roller for each of these belts is driven by the main prime mover (not shown) of the cigarette rod making machine. The rollers 3 and 13 or 14 form part of the drive means for belts 4 and 16. The main prime mover may be a variable-speed electric motor, a variable-speed hydraulic motor or an aggregate including a constant-speed motor and a variable-speed transmission. A plane whch is normal to the two longitudinally extending stretches of the belt 11 is substantially normal to a vertical plane which makes a right angle with the stretches of the belt 16. The position of the belt 11 with respect to the belt 4 is such that the plane of the upper stretch of the belt 4 makes a small acute angle alpha with the direction (arrow 21) of transport of tobacco particles on the belt 11. It can be said that the directions shown by arrows 5 and 21 make an oblique angle so that the transfer of tobacco from the belt 4 onto the right-hand stretch of the belt 11 (as viewed in FIG. 2) at the station A takes place in a region or zone 10 (shown in FIG. 1) whose length greatly exceeds the width of the belt 11. The layer of tobacco particles on the belt 11 is shown at 22; the magnitude of the angle alpha depends on the width of the layer 22.

The belts 11 and 16 make an angle beta, and one stretch of the belt 11 (namely, the left-hand stretch, as viewed in FIG. 2) crosses with one stretch of the belt 16 not unlike the blades of a shears. Both stretches of the belt 11 are outwardly adjacent to a suction chamber 23 having two walls which are immediately adjacent to the stretches of the belt 11 and are formed with suction ports 24.

The upper stretch of the belt 4 transports the sliver 6 toward the observer of FIG. 1, i.e., toward that stretch of the belt 11 which faces away from the observer of FIG. 1 and to the left, as viewed in FIG. 2. The just mentioned stretch of the belt 11 travels in a direction from the left to the right, as viewed in FIG. 1, i.e., from the roller 9 toward the roller 8, and the uppermost row of suction ports 24 in the corresponding wall 23A of the suction chamber 23 is parallel to the upper stretch of the belt 4. Therefore, these suction ports attract the particles of the sliver 6 to the adjacent stretch of the belt 11 to form thereon the aforementioned layer 22 whose height, as viewed in FIG. 1, increases in a direction toward the roller 8. The layer 22 thereupon travels about the roller 8 and the heavier tobacco particles (such as ribs and stem) are ejected from the layer 22 by centrifugal force to descend into a collecting receptacle 27. The bottom wall 27A of the receptacle 27 may constitute the upper stretch of a belt conveyor or a screw conveyor which transports the separated heavier tobacco particles to a further processing station, e.g., into a puffing apparatus. The lighter tobacco particles (i.e., mainly shreds of tobacco leaf laminae) continue to adhere to the outer side of the belt 11 and advance with the front stretch of this belt (as viewed in FIG. 1) in the direction indicated by arrow 21. Such particles are held against the belt 11 by streamlets of air flowing into the suction ports 24 in the wall 23B of the suction chamber 23. The uppermost suction ports 24 in the wall 23B form a row which is parallel or substantially parallel to the lower stretch of the belt 16 but are spaced apart from such lower stretch (see FIG. 2). The cylindrical wall of the roller 8 for the belt 11 is foraminous and the interior of this roller is connected with a suction generating device so that the lighter tobacco particles continue to adhere to the belt 11 during travel around the roller 8. The roller 8 is preferably driven by a discrete prime mover 26 (e.g., an electric motor) so that the belt 11 normally travels at a constant speed which is high enough to insure the segregation of heavier tobacco particles under the action of the centrifugal force.

The lighter tobacco particles which travel along the outer side of the wall 23B (i.e., along the outer side of the left-hand stretch of the belt 11, as viewed in FIG. 2) are separated from the belt 11 by air flowing into a suction chamber 29 and by compressed air issuing from an elongated nozzle 33 to enter an upwardly tapering tobacco channel 28 below the lower stretch of the belt 16. Such particles form the narrow tobacco stream 45. The lower stretch of the belt 16 travels below a perforated wall 31 forming part of the suction chamber 29 which causes the lighter particles to adhere to the belt 16 and to form the stream 45. The station where the particles of the layer 22 are transferred into the channel 28 is shown at B. The transfer of tobacco particles forming the sliver 6 onto the belt 11 is assisted by a suitably inclined blow nozzle 32 wherein compressed air flows in the direction indicated by arrows. Such air reduces the likelihood of adherence of tobacco particles to the belt 4 during travel of this belt around the roller 3.

The nozzles 32 and 33 are connected to the outlet 39 of a fan 42 by conduits 34, 36. The inlet 41 of the fan 42 is connected with the suction chambers 23, 29 by means of conduits 37, 38. The outlet 39 can discharge some compressed air into an opening 43 whose effective cross-sectional area is adjustable by a flap or the like; this opening is desirable because, as a rule, the apparatus requires more suction air than compressed air. A further conduit 44 connects the outlet 39 of the fan 42 with a nozzle 44A which admits compressed air into the channel 28 opposite the nozzle 33. It will be noted that the major part of air is circulated from the outlet 39 to the inlet 41 of the fan 42. It is clear, however, that the apparatus can include a discrete suction generating device which is connected with the chambers 23, 29 and a discrete source of compressed air which is connected with the conduits 34, 36 and 44.

The lower stretch of the belt 16 travels along an equalizing device 50 having two rotary knives 46, 47 which remove the surplus of tobacco so that the height of the tobacco stream which reaches the paper web 18 is constant. The knives 46, 47 are preferably adjustable so that they can change the height of the tobacco stream which reaches the garniture 17. For example, the knife 46 and/or 47 can be adjusted (by moving it nearer to or further away from the lower stretch of the belt 16) in response to signals from a detector which monitors the density and/or firmness of the filler of a cigarette rod. A rotary cam 48 may be mounted at the equalizing station to increase the density of spaced-apart portions of the stream 45; such cam will be used if the machine embodying the improved apparatus is to provide dense-end cigarettes. The cut-off mechanism of the machine severs the cigarette rod across those portions of the filler which are densified by the cam 48. The cam 48 can be installed between the knives 46, 47 (as shown in FIG. 1) or upstream of the knife 46.

The operation:

The belt 4 of the distributor 1 supplies a relatively wide carpet 6 which is assumed to include lighter and heavier tobacco particles. The height of the carpet 6 is small, especially when compared with its width. Successive increments of the carpet 6 are removed from the belt 4 at the transfer station A, partially by streamlets of air flowing into the suction ports 24 of the wall 23A and partially by compressed air issuing from the nozzle 32. The width of the layer 22 on the belt 11 increases owing to inclination of the belt 11 relative to the belt 4. It has been found that the streamlets of air flowing into the ports 24 of the wall 23A cooperate with air issuing from the nozzle 32 to build a homogeneous layer 22 which thereupon travels about the roller 8; the latter attracts the lighter particles but allows the heavier particles to enter the collecting receptacle 27. The remainder of the layer 22 is transferred at B into the channel 28 by air flowing upwardly through the wall 31 and by compressed air issuing from the nozzles 33, 44A, and the thus removed lighter particles form the stream 45 which adheres to the underside of the lower stretch of the belt 16. The length and inclination of the nozzle 33 in the wall 23B are indicated by the line 33A shown in FIG. 1. It will be noted that this nozzle is inclined with respect to the front stretch of the belt 11, as viewed in FIG. 1, so that it removes tobacco particles from a front edge of the layer 22 whose length is a multiple of the width of the belt 11.

The particles of the stream 45 are urged toward the underside of the lower stretch of the belt 16 by compressed air issuing from the nozzles 33 and 44A as well as by streamlets of air flowing into the suction chamber 29 through the interstices of the belt 16 and the perforations of the wall 31. The stream 45 is converted into an equalized stream by knives 46, 47 and is compacted at longitudinally spaced intervals by the rotating cam 48. The suction chamber 29 ends at the roller 14 so that the equalized stream descends (at the station D) onto the web 18 which is entrained by the upper stretch of the garniture 17. The latter transports the web 18 and the equalized stream through the wrapping mechanism 19 which converts the equalized stream into a rod-like filler and the web 18 into a tubular wrapper surrounding the filler and forming therewith a continuous cigarette rod. The manner in which the rod is converted into plain cigarettes forms no part of the invention.

Repeated reduction of the width of the mass of tobacco (carpet 6) issuing from the distributor 1 during conversion of such mass into the narrow stream 45 (i.e., a first reduction of width at the station A and a second reduction of width at the station B) takes place with assistance from air streams (i.e., streams issuing from nozzle 32 and streams flowing into the ports 24 of the wall 23A at the station A and streams issuing from the nozzles 33, 44A and flowing into the suction chamber 29 at the station B) and results in the formation of a homogeneous stream which, at least in some instances, can be wrapped without any trimming. The two stretches of the belt 11 are located in vertical or substantially vertical planes; one of these stretches receives tobacco particles at the station A to form the layer 22 and the other of these stretches delivers the layer 22 to the channel 28 at the station B. It is clear that the one-piece belt 11 can be replaced by two or more belts; however, the utilization of a one-piece belt is normally preferred in order not to affect the homogeneousness of the layer 22 during transport from the station A to the station B. The suction chamber 23 is elongated, i.e., it extends from the station A all the way to the station B.

The nozzles 32 and 33, 44A insure a reproducible transfer of tobacco from the belt 4 onto the belt 11 and from the belt 11 onto the belt 16.

The mounting of the belts 11 and 16 in such a way that one stretch of the belt 11 crosses with one stretch of the belt 16 (not unlike the blades of shears) is desirable in order to insure further homogenization of the stream 45, i.e., to eliminate or reduce eventual irregularities in homogeneousness of the layer 22 (such irregularities might develop as a result of segregation of heavier particles during travel around the roller 8). The feature that one stretch of the belt 11 receives tobacco from the belt 4 and the other stretch of the belt 11 delivers the layer 22 to the belt 16 contributes to compactness of the apparatus.

Another feature of the improved apparatus resides in the provision of separate drive means for the belts 4, 16 on the one hand and for the belt 11 on the other hand. Thus, the belt 11 can be driven at a constant speed which is high enough to insure segregation of heavier particles in the region of the roller 8 irrespective of eventual fluctuations in the speed of belts 4 and 16 which are preferably driven by the main prime mover of the machine.

The improved apparatus can receive the carpet 6 from a different distributer. For example, the distributor may comprise one or more winnowers which propel tobacco particles onto a plate-like conveyor replacing the conveyor belt 4 of FIGS. 1 and 2. The winnower or winnowers receive tobacco particles from a conventional picker roll cooperating with a carded drum which removes tobacco particles from the magazine of the distributor.

Figures 3, 4:
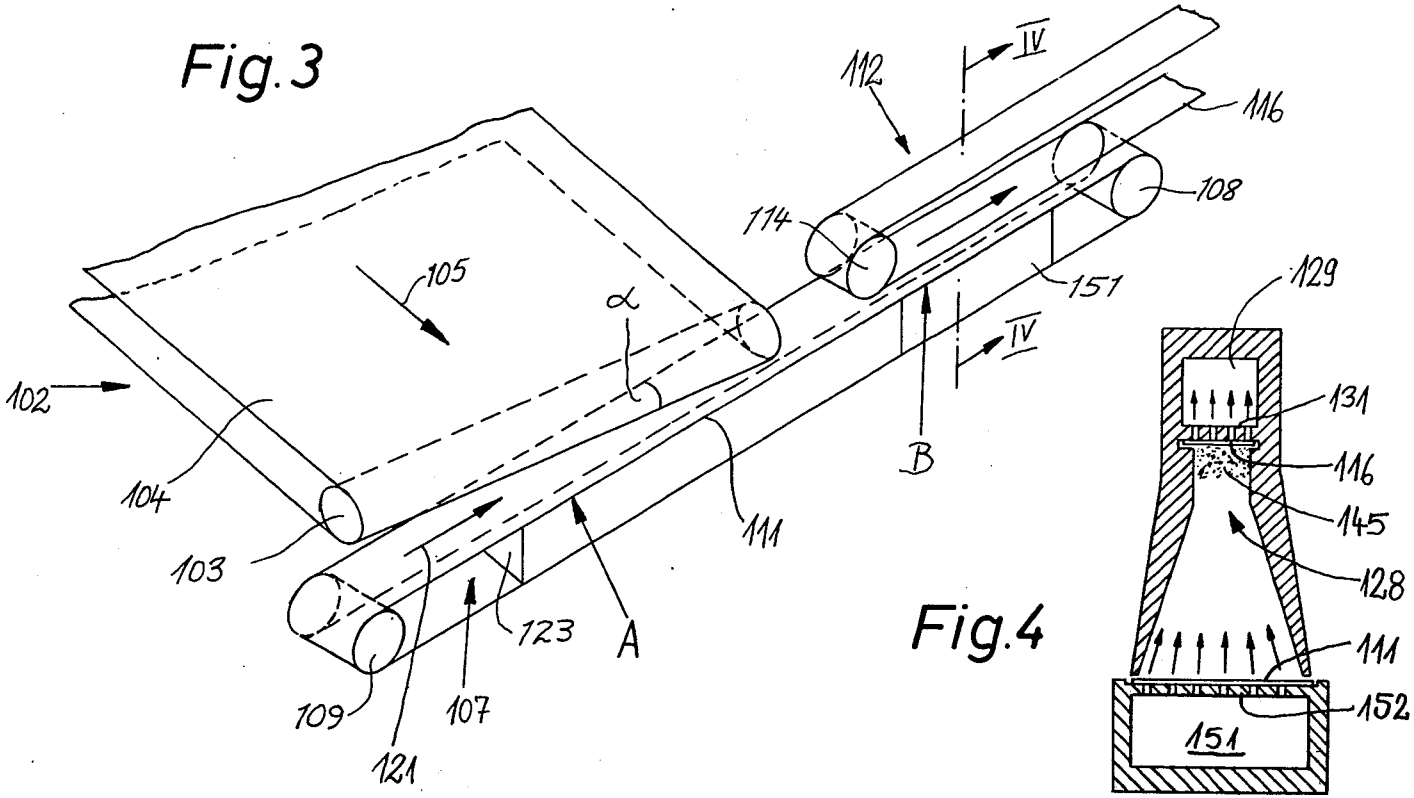
FIG. 3 is a fragmentary perspective view of a second apparatus.
FIG. 4 is an enlarged transverse vertical sectional view as seen in the direction of arrows from the line IV—IV of FIG. 3.

The apparatus of FIGS. 3 and 4 comprises an intermediate conveyor 107 having upper and lower stretches which are located one above the other. All such parts of this apparatus which are identical with or clearly analogous to the corresponding parts of the apparatus of FIGS. 1–2 are denoted by similar reference characters plus 100. As shown, the carpet on the upper stretch of the belt 104 leaves the conveyor 102 at the transfer station A to form a growing layer which accumulates on the upper stretch of the belt 111. The axis of the roller 103 for the belt 104 makes an acute angle alpha with the direction (arrow 121) of travel of the tobacco layer on the upper stretch of the belt 111. At the station B, the layer is transferred onto the lower stretch of the belt 116 of conveyor 112 in a manner as shown in FIG. 4. The directions indicated by arrows 105 (carpet on the belt 104) and 121 make an oblique angle.

In the region between the transfer stations A and B, the upper stretch of the belt 111 travels above the perforated top wall of a suction chamber 123 analogous to the suction chamber 23 of FIG. 2 and serving to attract the tobacco layer to the belt 111. The suction chamber 123 ends at the station B and is followed by a plenum chamber 151 which discharges compressed air through orifices in a top wall 152 whereby the air causes successive increments of the layer to travel upwardly, i.e., into the channel 128 and toward the underside of the lower stretch of the belt 116. The particles form a narrow stream 145 which is thereupon trimmed and transferred onto a garniture in the same way as shown for the stream 45 in the apparatus of FIGS. 1 and 2.

Since the particles of the layer on the belt 111 need not travel about the roller 108 and/or 109, the aforementioned suction chamber which is mounted between the two stretches of the belt 111 need not have any orifices in the lower wall thereof.

The speed of the belt 104 is preferably substantially less than the speed of the belt 111. When the apparatus is in use, tobacco particles constituting successive increments of the carpet on the belt 104 trickle onto the upper stretch of the belt 111 at the station A and are attracted to the belt 111 by the aforementioned suction chamber which precedes the plenum chamber 151 of FIG. 4. If desired, the transfer of tobacco particles from the belt 104 onto the belt 111 may be assisted by a nozzle corresponding to the nozzle 32 of FIG. 2. The belt 111 builds up a relatively wide layer which advances toward the station B and is transferred onto the underside of the belt 116 by compressed air issuing from the chamber 151 as well as by suction in the chamber 129. The thus obtained stream 145 travels with the lower stretch of the belt 116 toward the garniture (not shown). The lower stretch of the belt 116 overlies the upper stretch of the belt 111 at the transfer station B.

An important advantage of the improved apparatus is that repeated transfer of tobacco from conveyor belt to conveyor belt under the action of air streams contributes to more satisfactory homogeneousness of the stream 45 or 145. Moreover, the separation of heavier tobacco particles from those which should form the stream 45 or 145 can take place at a locus (roller 8) where the removed particles do not interfere materially with distribution of satisfactory particles. It has been found that the homogeneousness of the stream 45 or 145 at least equals and can substantially exceed the homogeneousness of the carpet on the belt 4 or 104. Also, the height of the stream 45 or 145 is uniform or nearly uniform so that the quantity of tobacco removed by the trimming device is smaller or negligible; this is highly desirable since the trimming device invariably reduces the size of at least some shreds and produces a certain amount of dust. As a rule, the manufacturers of cigarettes or the like strive to operate the machines in such a way that the trimming device or devices must remove small quantities of tobacco before the stream reaches the wrapping mechanism.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims.

1. Apparatus for converting a wide carpet of tobacco particles into a narrow stream, comprising a first conveyor having means for transporting said carpet in a first direction along a first path; a second conveyor having a first foraminous belt for transporting said stream along a second path which is spaced apart from said first path and a first suction chamber adjacent to said second path, said belt being located between said suction chamber and said second path; an intermediate conveyor having a second foraminous belt defining a third path extending between said first and second paths, means for moving said second belt in a second direction from said first path toward said second path and a second suction chamber adjacent to said third path, said second belt being located between said second chamber and said third path, the width of said second belt exceeding the width of said first belt and said first and third paths being inclined with respect to each other so that said first and second directions make an oblique angle; means for evacuating air from said second chamber to thereby transfer the particles of said carpet into said third path along a zone having a length exceeding the width of said second belt due to the inclination of said first and third paths with respect to each other, the thus transferred particles forming on said second belt a layer which advances along said third path toward said second path; and means for evacuating air from said first chamber to thereby transfer the particles of said layer from said third path into said second path with attendant conversion of said layer into said stream.

2. Apparatus as defined in claim 1, wherein said first belt has an upper stretch and a lower stretch, said first suction chamber being adjacent to the upper side of said lower stretch so that said stream is attracted to and adheres to the underside of said lower stretch.

3. Apparatus as defined in claim 2, wherein said second path is elongated and said first suction chamber has a predetermined length and includes an end which is remote from said third path so that successive increments of said stream leave said second path by gravity at said end of said first chamber, and further comprising a fourth conveyor for transporting a continuous web of wrapping material below said end of said first chamber so that the wrapping material intercepts successive increments of said stream and advances with such increments beyond said end of said first chamber.

4. Apparatus as defined in claim 1, wherein said third path has first and second ends which are respectively adjacent to said first and second paths and further comprising nozzle means adjacent to at least one end of said third path and means for supplying compressed air to said nozzle means, said nozzle means being positioned to discharge compressed air in a direction such as to promote the transfer of tobacco particles onto the respective belt.

5. Apparatus as defined in claim 1, wherein said first and second belts respectively have first and second tobacco transporting stretches and the planes of said first and second stretches are normal to each other.

6. Apparatus as defined in claim 1, wherein said first belt has a first elongated stretch to which said stream adheres in response to evacuation of air from said first chamber and said second belt has a second elongated stretch to which said layer adheres in response to evacuation of air from said second chamber, said first and second stretches being adjacent to and crossing each other.

7. Apparatus as defined in claim 1, wherein said second belt has a first stretch which receives tobacco particles from said first path and a second stretch which delivers the layer to said first belt.

8. Apparatus as defined in claim 1, further comprising separate drive means for said first and second conveyors.

9. Apparatus as defined in claim 1, wherein said first conveyor comprises a third endless belt which includes an upper stretch and a lower stretch.

10. Apparatus as defined in claim 1, wherein each of said belts has an upper stretch and a lower stretch, one of said belts being disposed at a level above the other of said belts in the region where the particles of said layer are transferred into said second path.

* * * * *